US005216961A

United States Patent [19]

Gray

[11] Patent Number: 5,216,961

[45] Date of Patent: Jun. 8, 1993

[54] BOOK INDEX NOTCH CUTTER

[76] Inventor: Stephen B. Gray, 1115 19th St. #10, Santa Monica, Calif. 90403

[21] Appl. No.: 789,352

[22] Filed: Nov. 8, 1991

[51] Int. Cl.[5] ..... B26D 1/12; B26D 7/18

[52] U.S. Cl. ..... 83/128; 83/144; 83/468.8; 83/468.93; 83/671; 83/904; 83/917; 30/128

[58] Field of Search ..... 83/128, 468, 468.8, 83/468.93, 671, 693, 904, 917, 125, 144; 30/268, 128

[56] References Cited

U.S. PATENT DOCUMENTS

| | | | |
|---|---|---|---|
| 1,381,814 | 6/1921 | Farkas et al. | 83/904 X |
| 1,764,828 | 6/1930 | Cotton | 83/904 X |
| 2,076,436 | 4/1937 | Nelson | 83/917 X |
| 2,615,245 | 10/1952 | Schaumleffel | 30/130 |
| 2,620,874 | 12/1952 | Chase . | |
| 3,357,289 | 12/1967 | Thomson | 83/917 X |
| 3,728,926 | 4/1973 | Clayton | 83/468.93 |

*Primary Examiner*—Eugenia Jones

[57] ABSTRACT

A hand-held, manually operated book index notch cutter is placed in the book to be notched. The notch cutter has a cylindrical cutting member (405) which moves parallel to and rotates around its axis. The axis of the cylinder is perpendicular to the book leaves being notched. The cutting member rotates and advances within a cutter guide (200), which is attached to a thin baseplate (100). The upper surface of the baseplate is a resilient platen (102) on which rests the stack of book leaves to be cut. These leaves are adjusted in fan and lateral angle with the help of a leaf guide (300), which is movable to allow a range of notch depths. The cutting member is attached to a knob (401) which is pressed and turned. Inside this cutting member-knob assembly is a spring-loaded ejector assembly (500). After a notch is cut, the ejector button (501) is pressed, capturing the paper cuttings and raising the cutting member to the ready position. Then the entire index notch cutter is removed from the book and placed over a wastebasket, and the ejector button is released, causing the paper cuttings to fall.

12 Claims, 3 Drawing Sheets

BOOK INDEX NOTCH CUTTER

FIELD OF THE INVENTION

This invention relates to book index notch cutters, specifically to portable, handheld notch cutters for use by individual book owners.

BACKGROUND OF THE INVENTION

This invention is an improved machine for cutting index notches in books, magazines, catalogs, and other reading or reference material.

Index notches offer advantages over other methods of marking book sections or pages. These marking methods include protruding tabs and leaf-edge marking techniques. Protruding tabs can be easily torn or tear the leaf they are attached to. They are unsightly and can be squashed flat when the book is placed in a shelf. In the leaf-edge marking technique, typically all the leaves in the section to be marked are printed with a contrasting band along their fore-edge, extending beyond the position where the leaf edge is to be sheared. This method adds no extra steps to book manufacture, but cannot convey any printed information such as the name or number of the section, the letter of the alphabet (as in a dictionary), or the like.

An improved leaf edge marking technique uses short stripes printed on the fore-edges of all leaves in a section of the book. There is also a contents page, typically just inside the front cover, on which each section title is positioned vertically to correspond to the vertical position of that section's fore-edge stripes. This method is superior in convenience to other prior art for non-alphabetic reference books, but is found in only a small fraction of the books where it would be useful. It must be included in the book when it is manufactured, and cannot be easily put in by the book user, or customized to the user.

In the prior art of index notches, they are used almost exclusively in alphabetically ordered books such as dictionaries. In such volumes, the notches typically show only one or two letters, allowing the user to quickly turn to the beginning of the "M" section, for example.

This use of notches, although very common, is of limited value because once the user has reached the first page of the M's, he or she still has several iterations to do on subsequent letters of the target word before the desired page is reached. Thus an alphabetic notch helps with only the first of several steps. In addition, knowing the alphabet, one can usually get close to the desired first letter even without notches, simply by guessing its position. For example, the M's would be found near the middle of a dictionary or telephone directory.

Notches also substantially increase the cost of production of a book. In spite of their disadvantages, notches are still popular, because any gain in efficiency of use is valuable in a reference book.

There is also much printed reference material which is not organized alphabetically, including most catalogs, textbooks, law books, medical texts, technical reference material, repair manuals, contractor's specifications, history books, etc. In these the order of material is frequently logical, chronological arranged by subject, etc.

For example, a user of a computer reference book on a spreadsheet program may need to refer frequently to the section on graphs, or on macros. Or, a user of an industrial hardware catalog may need to turn frequently to the section on flat-head screws. It would be useful if such a user could make a notch which lead him or her immediately to the desired section. This lets the user avoid several steps: finding the index, looking up the desired item in it, and turning to the correct page. Such a set of notches would serve as a short, customized table of contents.

For this use, the notch would have to be big enough to show a label typically comprising a few words, rather than just a letter or two. Therefore notches for use in non-alphabetic material should be larger than typical notches found in dictionaries, for example.

There is also much reference material published without notches, usually for reasons of cost. Use of many of these, for example telephone directories, would benefit from simple alphabetic notches, just as dictionaries do. Much of this reference material is printed with narrow margins, also for reasons of cost. A truly versatile notch cutter should therefore be able to cut shallow notches or large ones.

PREVIOUS RELATED INVENTIONS

Attempts have been made to develop devices that could be sold at low cost to individual book owners who want to notch their own dictionaries, telephone books, reference books, or the like.

Clayton (U.S. Pat. No. 3,728,926; Apr. 24, 1973) describes a notch cutter which operates somewhat like a standard hole punch for paper, operating with a shearing action. In this notch cutter, the leaf fore-edges are abutted against an alignment guide which fans them at an acute angle relative to the line of punch motion. This assures that the punch, which moves straight down perpendicular to the leaves and toward the table surface, makes a slightly deeper circular cut in each successive leaf, giving the final notch the desired height and depth. The cutting member, which is a hollow cylindrical punch, shears through the stack of leaf edges, which are supported by a matching die surface cut into the base of the notch cutter.

The Clayton patent discloses a cutting edge which is not perpendicular to the cutter axis. Instead, it lies in a plane at an acute angle from the axis, with the goal of reducing cutting force. For sharpness, this angled edge would require an internal angled chamber, which is an unconventional machining operation. As actually sold, the cutting edge is perpendicular to the cutting member's axis, easier to manufacture but harder to force through the leaves.

This device is not available in the marketplace, for several probable reasons. One problem would be the excessive required operating force. In making a notch, both the number of leaves being severed and the length of the punch line in each leaf are much greater than those in a standard three-hole punch, where the operating forces are already high. Because of this high force, the Clayton invention requires very sturdy construction, increasing its cost. Also the device as it was actually sold had a lever giving a high mechanical advantage to the operator, relative to the punch force itself. This would reduce the operator's peak exertion, but increases the device's size, weight, and cost.

Further, the punching or shearing action necessitates a punch die, closely matched to the cylindrical punch. Both punch and die must be machined to close tolerances. Because of the high peak stress, which increases if the punch or die gets dull, both pieces should be treated for hardness and toughness. Because of all these factors, the Clayton invention would have a high production cost, limiting its usefulness. Finally, the use of a larger notch size or more generous cutout angle (described as 30 degrees) are discouraged, because increasing either would further increase the operating force.

Another cutting action available for circular cuts in paper is a slicing motion, in which the circular cutting edge actually rotates as it advances. This is like more like a paper drill than a paper punch.

This action in an index notch cutter is described by Chase (U.S. Pat. No. 2,620,872; Dec. 9, 1952). In this device the cutting member is operated by the user by means of a knob, which is simultaneously pushed downward toward the leaves and twisted in a circular manner, giving an arcuate cut. The hollow cylindrical cutting member is guided toward and through the book leaves by a guide which is angled with respect to the leaves, rather than being perpendicular to them. The leaf edges are not fanned at an acute angle as in Clayton, but are all held perpendicular to the surface of the leaves. As the cutter advances, it exits through book's fore-edge at an acute angle, giving a notch of the desired shape.

However, since only a small part of the cutting member's circular cutting edge initially contacts the paper, the cutting edge acts as a wheel. Since the cutting edge meets resistance, there is in effect high friction between the "wheel" or cutting edge and the leaf, so the cutting member tries to roll along the leaf edge toward the leaf top or bottom. In the Chase invention, holding the cutting member still against the leaf, so that it will cut in place instead of rolling, is accomplished with a complex clamping mechanism.

Also, for this angled cutting member technique to produce consistent notch sizes and shapes throughout the width of the book, the book's fore-edge, and therefore its spine, must be substantially planar. This is generally true of telephone books, for which the device was intended, but is untrue of most hardbound books, which usually have a curved spine. Further, when a telephone or similar book is opened, say near a middle page, there is a strong tendency for the spine to lie back, causing the stack of leaves on the right to fan out at an acute angle. This angle would prevent the notch from having the desired shape.

For these reasons, the Chase invention necessarily holds the entire book in a sturdy frame, and clamps the spine of the book while the notches are cut. Its construction makes it useful only for softbound books, whose cover can be bent far back. It best handles fixed a book depth and a fixed notch spacing. The Chase device is about twice the size of a telephone directory and in production would contain over one hundred parts. For these reasons the Chase invention is best suited to very specific application such as semi-production alphabetic notching of telephone directories, and does not apply to personalized notching of books by their owners.

OBJECTS AND ADVANTAGES OF MY INVENTION

My improved book index notch cutter has the following general properties and advantages.

1. It uses no electrical or other power source, operating manually.

2. It is handheld, being placed on or in the book while in use, thus requiring no frame.

3. It is small, light, and easy to store.

4. Its use requires minimal manual force.

My improved notch cutter has the following major operational properties and advantages.

5. It can cut notches of a continuous range of sizes, allowing small notches to be made in books with narrow margins, large notches which can accommodate a dozen or more characters on the notch label, and any size between.

6. It will operate on books, magazines, and other reading or reference material, regardless of height, width, or thickness.

7. It will operate on hardcover or softcover books.

8. It will operate on books whose spines are straight like a typical softcover, curved like a typical hardcover, or anything between.

My improved notch cutter has the following additional operational properties and advantages.

9. It can cut notches whose depth is more than half of the notch diameter, giving each notch a generous writing area while allowing the book's fore-edge to accommodate a larger number of notches than if they were wide and shallow.

10. It informs the operator when the cut is done, by means of an audible and/or tactile signal.

11. The notch cutter maintains itself in the ready position.

12. Action of the cutting member tends to stabilize the lateral position of the notch cutter against unwanted displacement.

13. Design of the notch cutter further discourages accidental slippage during use without having to hold the book in a frame.

14. In case of an incomplete or too-shallow cut, the notch cutter can be placed to that the cut can be completed with accurate alignment.

15. The notch cutter's base is thin, which simplifies correct positioning of the leaves to be notched. It also discourages anomalous positioning of the last leaf to be notched. Further, it allows the notch cutter to be smaller and lighter than if a thick base were used.

My improved index notch cutter has the following properties and advantages relating to alignment and adjustment.

16. It incorporates an alignment guide allowing the user to easily set and verify the leaves' fan angle.

17. It incorporates an alignment guide which helps the user to set the notch cutter's lateral angle correctly perpendicular to the book's fore-edge.

18. It has calibration marks allowing the user to set the notch depth to the desired amount.

19. It has a notch spacing guide helping the user to space successive notches at even intervals along the fore-edge.

My improved index notch cutter has the following properties and advantages relating to disposal of paper cuttings.

20. It captures the paper cuttings in a chamber, keeping them from spilling on the user's work surface.

21. The capture chamber and cutting member are combined, eliminating a separate chamber as required in the Clayton invention, and allowing a light, thin base to be used.

22. It allows a simple, quick action for disposal of the paper cuttings, using only one hand.

23. The paper cuttings disposal action also accomplishes restoring the cutting member to its starting position, minimizing separate operations.

24. It has provision for releasing any paper cuttings that get stuck in the capture chamber.

My improved book index notch cutter has the following properties and advantages relating to safety and durability.

25. Its use does not require sudden or forceful motions, which could injure the user.

26. Its cutting edge is largely inaccessible to the operator's fingers, reducing the possibility of injury.

27. Its cutting edge is protected from damage in case the notch cutter is dropped onto a hard surface.

28. Its cutting edge is not subject to banging or sudden impact.

29. Its cutting edge does not contact another hardened edge or part, even in case of poor manufacturing tolerances.

My improved book index notch cutter has the following properties and advantages relating to manufacturing.

30. It can be made with relatively light construction since no high forces are involved.

31. It can be made using at most one custom-machined part, other parts being stamped or molded.

32. Its inherently low cost and versatility makes it accessible to many potential users.

In the present invention, the cutting member rotates around its axis and moves forward along it, and its axis is perpendicular to the leaves being cut. As will be seen, this combination leads directly to the advantages listed above as numbers 2–4, 12, 25, 28, and 30, any one of which is lacking in either the Clayton or Chase approaches.

LIST OF REFERENCE NUMERALS

Figure 1:
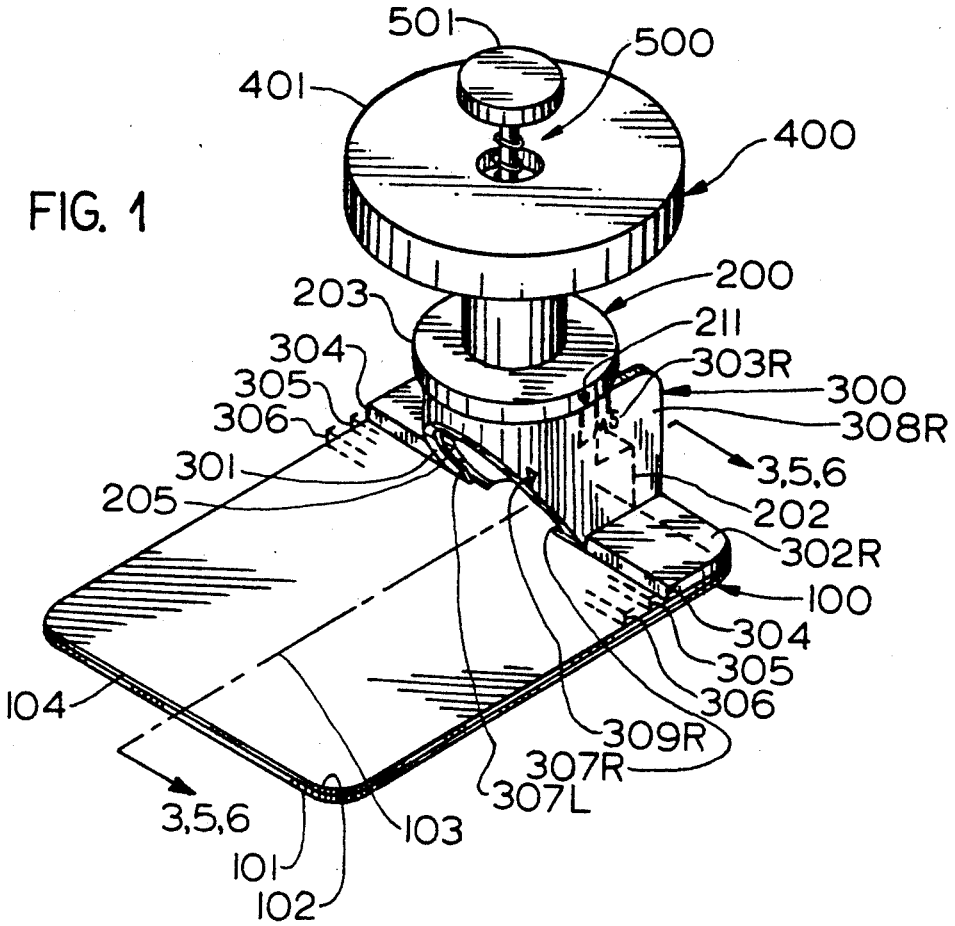
FIG. 1 is a perspective view of a preferred embodiment of the notch cutter, showing the cross-section line 3—3.

The first main component of the invention is base assembly 100, having constituent parts numbered 1xx as follows:

101: rigid support plate
102: resilient pad
103: lengthwise centerline of base and notch cutter
104: front edge of base
105: screw holding cutter guide 200 to base 100
106: locator hole for pin 212
107: hole in base for screw 105.

The second main component is cutter guide 200, having illustrated parts as follows:

201: cutter guide cylinder with cavity
202: cutter guide mounting shoulder
203: cylinder top flange
204: top surface of flange 203
205: angled cut for leaf clearance
206: tapped hole for screw 105
207L,R: left, right recesses for clamping leaf guide 300
208: lowest or main bore section of cavity in cylinder 200
209: tapered section of cavity
210: collar section of cavity
211: reference mark for notch size calibration
212: locator pin fitting into hole 106.

The third main component is leaf guide 300, with illustrated parts as follows:

301: fan angle guide surface
302L,R: left right leaf guide arms
303L,R: notch size calibration marks, Large, Medium, Small
304: leaf guide front surfaces, Large position
305: leaf guide front surfaces, Medium position
306; leaf guide front surfaces, Small position
307L,R: left, right clamping shoulders
308L,R: left right flat side walls of leaf guide
309L,R: left, right notch spacing marks
310: maximum notch depth at this setting of leaf guide.

The fourth main component is cutting member-knob assembly 400, with illustrated parts as follows:

401: knob
402: through-holes for ejector mechanism
403: threads on cutting member 405, mating with knob 401
404: washer for detecting end of cut
405: cutting member
406: neck of cutting member
407: square cross-section O-ring
408: cutting member main diameter
409: cutter cavity for chip accumulation
410: cutting edge of cutting member 405.

The fifth main component is ejector assembly 500, with illustrated parts as follows:

501: ejector pushbutton
502: ejector shaft
503: compression spring
504: chip ejector disk
505: chip sweep blade.

For clarity, book being notched is shown as another component 600, with illustrated parts as follows:

601: leaf stack turned back
602: leaf stack above notch cutter base
603: leaf stack below notch cutter base
604: book spine
605: fore-edges of book leaves to be cut
606: bottommost leaf to be notched
607: pile of paper cuttings or chips.

STRUCTURE OF THE PREFERRED EMBODIMENT

A base assembly 100 consists of a rigid plate 101, which may be for example made of steel about 1/16 inch thick, approximately two inches wide by three inches long. Cemented or otherwise affixed atop this plate is a pad 102, made of resilient material such as medium to firm rubber, neoprene, or vinyl, which can be substantially the same size as plate 101.

All dimensional values given are only exemplary and can be varied over a suitable range without affecting the principles of the invention.

Figure 4:
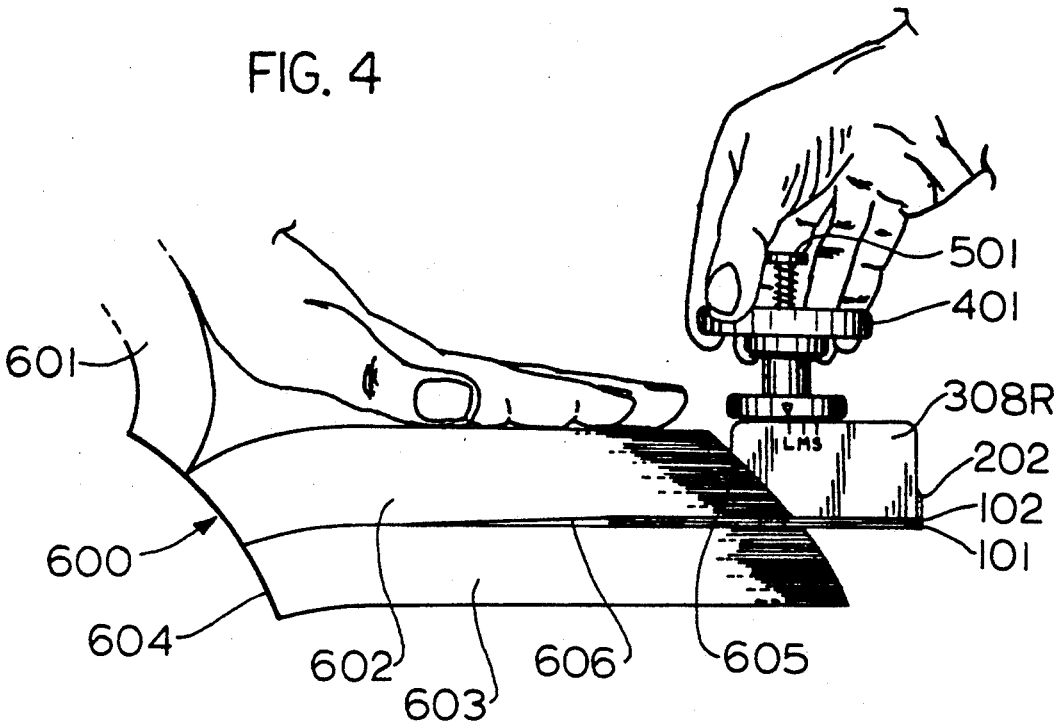
FIG. 4 is a side elevation view of the book and notch cutter in correct relative positions, also showing an operator's right hand in the notch-cutting position, and left hand holding the notch cutter in place and holding the book open.

The resilient pad 102 is chosen to have a high-friction surface when in contact with paper. This pad 102 serves several purposes. As seen in FIG. 4, when the notch cutter is placed in the book, a last leaf to be notched 606 rests against pad 102, whose high-friction surface helps prevent the notch cutter from shifting from respect to the book leaves during the notch cutting operation.

Figure 3:
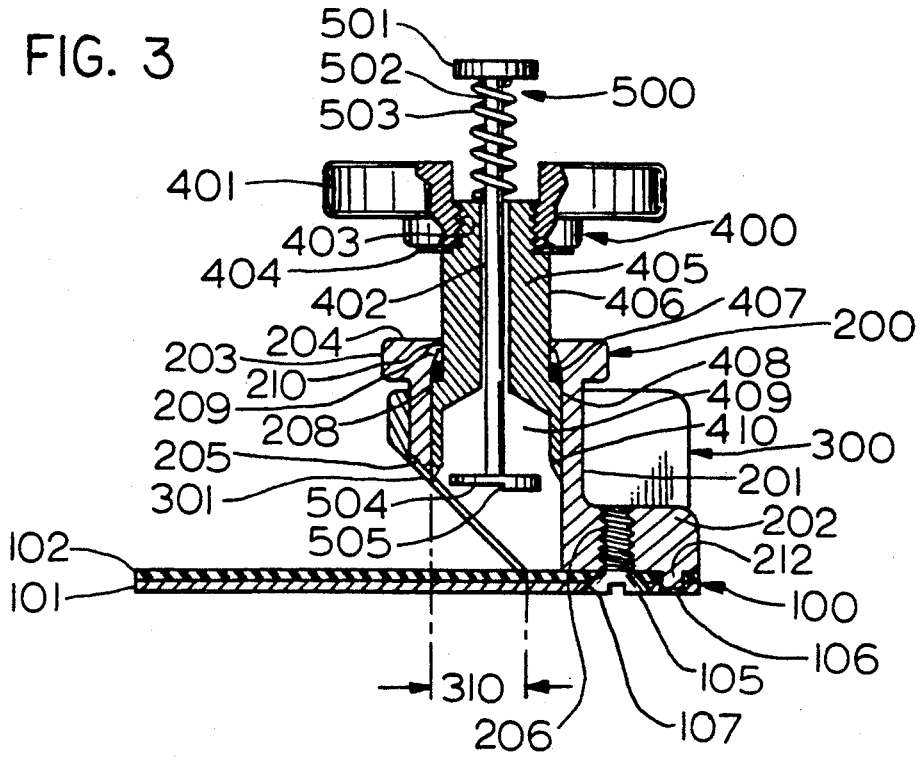
FIG. 3 is a detailed cross section of the notch cutter along base center axis 103.

As seen in FIG. 3, the next purpose of pad 102 is to serve as a non-machined platen, supporting the book leaves while they are being sliced by a sharpened cutting edge 410.

Figure 2:
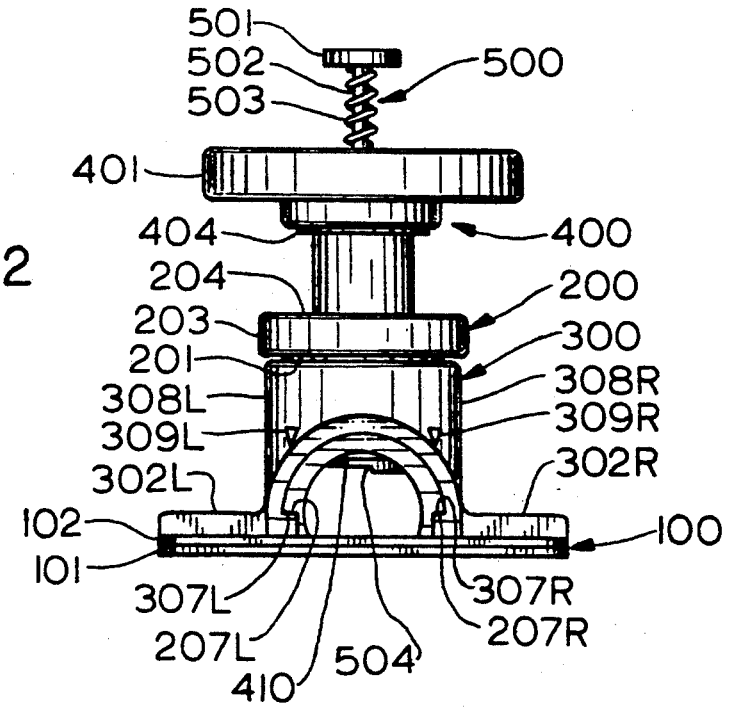
FIG. 2 is an elevation view of the notch cutter, viewing toward front edge 104 of base 100.

As seen in FIG. 2, a third purpose of pad 102 is to serve as a clamp surface against which a leaf guide 300 is forced by a cutter guide mounting shoulder 202. The high friction surface of pad 102 assures that leaf guide 300 will not move accidentally.

As shown in FIG. 3, a cutter guide 200 comprises a hollow cylindrical section 201 and an attached mounting shoulder 202. Cylinder 201 and its cavity have axes perpendicular to base assembly 100. Atop cylinder 201 is a flange 203 which is for finger support. At its bottom, cylinder 201 has an angled cut-off surface 205, for example at 45 degrees, for leaf clearance. An internal cavity in cylinder 201 has three sections. First, three is a main guide cavity diameter 208, which slips-fits a cutting member main diameter 408 and prevents lateral movement of cutting member 405. Directly above main bore diameter 208 there is a tapered section 209, which for example is about 0.1 inches long, and whose sides form a six degree angle with the axis of cylinder 201. These dimensions allow taper 209 to receive O-ring 407, which can temporarily jam partway into it, as will be seen. Finally, the cavity in cylinder 201 has a collar section 210, forming a slip fit with a neck section 406 on a cutting member 405. Collar 210 prevents a cutting member-knob assembly 400 from becoming separated from the rest of the notch cutter. This prevents cutting edge 410 from becoming exposed where it could be damaged by dropping, or cut the operator's fingers, or get lost.

Referring to FIG. 3, cutter guide 200 is attached to base 100 by means of a screw 105 which passes through a clearance hole 107 in base 100 into a tapped hole 206 placed in cutter guide mounting shoulder 202. The position and alignment of the cutter guide 200 with respect to the base assembly is further constrained by an locator pin 202 which fits into a hole 106. Cutter guide 200 can be molded, for example, in any strong, rigid plastic.

Leaf guide 300 has an angled surface 301 facing forward toward notch cutter front edge 104, at for example, a 45 degree angle with respect to base assembly 100. Surface 301 determines the leaf fan angle, when the notch cutter is placed firmly against a set 605 of fore-edges of book leaves to be notched, as shown in FIG. 4. Leaf guide 300 also has a pair of arms 302L,R extending out to the sides. When the notch cutter is correctly placed in a book 600 to be notched, arms 302 will be in contact with the fore-edge of last leaf to be notched 606. This assures that a lengthwise centerline 103 of base 100 is perpendicular to leaf edges 605, and that the notch cutter is fully seated. Then if the notch cutter does not move during the cut, the notch will be of the expected size.

Leaf guide 300 is adjustable for different notch cutting depths. The notch depth in the last or lowest leaf to be cut is shown in FIG. 3 as dimension 310, which varies depending on the setting of leaf guide 300. The largest notch is obtained with leaf guide 300 pushed in all the way so that it is directly against the cutter guide 200, as shown in FIGS. 1 and 3. It will be seen that the maximum notch depth is greater than half the diameter of the cutting member.

Small notches can be cut with the leaf guide positioned farther from the cutter guide 200. As shown in FIG. 1, a set of calibration marks 303R allow the operator to set the notch size to particular values, such as large (L), medium (M), and small (S), by aligning one of calibration marks 303 with a reference mark 211. For example, if the cutting member 405 has a diameter of $\frac{3}{4}$ inch, these notch depths could be $\frac{1}{2}$ inch, $\frac{3}{8}$ inch, and $\frac{1}{4}$ inch, respectively. The leaf guide position is continuously adjustable, so that exact alignment with one of mark set 303 is not necessary. In FIG. 1, leaf guide arms 302 are shown in Large position 304, and their positions for Medium 305 and Small 306 settings are shown as phantom positions.

A corresponding set of calibration marks 303L, not visible in any figure, is located on left surface 308L, for use in case the notch cutter is used in a reversed orientation.

Leaf guide 300 is held in place by friction between base pad 102 and cutter guide mounting shoulder 202, which are forced together by tightening screw 105. As best seen in FIG. 2, the clamping pressure is directly exerted by a pair of recesses 207L,R in cutter guide 200, upon a corresponding pair of shoulders 307L,R in leaf guide 300. The clamping pressure will cause resilient base bad 102 to indent slightly, which will hold leaf guide 300 in place even more effectively than friction alone. Leaf guide 300 can be molded, for low cost, in any strong, rigid plastic.

The cutting member-knob assembly 400 consists of a cylindrical cutting member 405 made for example of hardened steel, rigidly attached to a machine or control knob 401, which can be of molded plastic. The sharpened end 410 of cutting member 405 is perpendicular to the axis of cutting member-knob assembly 400. The attachment of knob 401 to cutting member 405 can be, for example, by means of threads 403 on cutting member 405.

At the end of the cut, cutting edge 410 penetrates a small distance, for example 0.01 inch, into resilient pad 102. Dimensions in the cutting member-knob assembly 400 and cutter guide 200 are chosen such that when the cut is finished, washer 404 contacts a top surface 204 of flange 203. Washer 404 is made of a soft vinyl or the like with an extremely smooth surface finish, as is commonly found on clear vinyl sheeting. Surface 204 also has a polished finish. When washer 404 and surface 204 contact, there is an electrostatic attraction which produces a sudden sticking, resisting effort by the operator to turn knob 401. This sudden resistance is immediately sensed by the operator, providing an tactile signal that the cut is complete.

Depending on the exact finish and cleanliness of washer 404 and surface 204, the electrostatic attraction may create a slip-stick phenomenon, producing an obvious tactile sensation. Further, depending on the pressure exerted by the operator, the slip-stick will result in an audible squeak, providing an another indication of end-of-cut.

This end-of-cut detection provision is important because all of cutting member 405 is hidden from view at the end of the cut, and because it is inconvenient for the operator to look continuously and closely at the remaining space between the bottom of knob 401 and flange surface 204.

An alternative means of indicating end-of-cut is to make washer 404 or the bottom of knob 401 have a radial pattern of serrations or ridges, similar to the patterns in a belleville washer. Surface 204 is given a complementary pattern. When the two come together, washer 404 is still rotating, and their ridges will bump together, creating a tactile and audible effect.

A further alternative means is to apply weak, reusable adhesive to both the bottom surface of knob 401 and to top surface 203 of flange 204. Upon contact at the end of cut, the temporary adhesion of these surfaces prevents further turning of knob 501, which effect can be felt.

Above wide diameter section 408 of cutting member 405 is a flat shoulder onto which is attached an O-ring 407 made of deformable material such as rubber, vinyl or the like. When the operator retracts the cutting member-knob assembly 400 to its uppermost position, O-ring 407 will be squeezed into taper section 209 in cutter guide 200, and become stuck against taper 209. This has the effect of keeping cutting member-knob assembly 400 in the raised position by itself, ready for the next cut. When cutting member-knob assembly 400 is pushed by the operator to a lowered position for the next cut, O-ring 407 is easily freed from taper 209. The diameter of O-ring 407 is smaller than bore diameter 208 and does not contact it during a cut. O-ring 407 has a square cross-section to prevent it from rolling, which makes its action less predictable.

During the cut itself, the operator'effort is not opposed by O-ring 407, washer 404, or as will be seen, spring 503.

Cutting member 405 shown as one piece for simplicity. For lower cost and weight, it could be made mostly from molded plastic, with only cutting edge 410 and the immediately adjacent section made from hardened steel.

The cutting member-knob assembly 400 has an on-axis hole 402 through which passes a round shaft 502 of an ejector assembly 500. The axis of ejector assembly 500 generally coincides with the axis of cutting member-knob assembly 400. At its lower end, shaft 502 has immovably attached a round ejector disk 504, and at its upper end is immovably attached a pushbutton 501. The neutral position of this assembly, with no pressure by the operator on the button, is maintained by a compression spring 503. In this neutral position, disk 504 is slightly below cutting edge 410, as shown in FIGS. 2 and 3. Disk 504 is made to have a loose slip fit in a cavity 409 in cutting member 405.

The bottom surface of circular ejector disk 504 has a raised segment, covering less than half the disk surface and not enclosing its center. This thicker portion is separated from the thinner portion by a planar edge 505, whose height is the thickness of a few pieces of paper, said 0.02 inch. Edge 505 can act as a rotating blade for dislodging any stuck chips, as described below.

Certain dimensions in the notch cutter must relate correctly to each other. Assume the maximum notch depth is ½ inch, and leaf guide fan surface 301 is at a 45 degree angle. Then the cutting member 405 will be penetrating vertically through ½ inch of paper, so its rest position as seen in FIG. 3 must be at least ½ inch above base pad 102 so that it will have sufficient travel. Therefore the length of neck 406 between washer 404 and flange surface 204 must also be ½ inch. During cutting, chip ejector disk 504 will travel upwards in cutter cavity 409 by the height of a chip pile 607, which generally will not be more than ¼ inch, so cutter cavity 409 must have adequate clearance for this travel of disk 504.

OPERATION OF PREFERRED EMBODIMENT OF NOTCH CUTTER

First, a book 600 to be notched is examined to determine its minimum outside margin width. Using this distance, and knowing the amount of material to be written in each notch, the operator moves leaf guide 300 to the desired setting, whether Large, Small, or something between. To move leaf guide 300, screw 105 is unscrewed slightly, allowing cutter guide 200 to lift somewhat from base 100. Leaf guide 300 is then slid to the desired position, and screw 105 is retightened. This adjustment will usually be done once per book.

The deepest practical notch depth is about ⅔ of the cutter diameter. At this setting, at the end of a cut, the cutting member 405 will be partially entrapped in the notch it has cut, because the opening in the notch is slightly smaller than the diameter of the cutting member 405. Due to the flexibility of paper, the cutting member 405 can easily be freed without tearing or straining. Notches this deep have a relatively efficient shape for writing several words, compared to their width.

For a notch to be used for opening book 600 to, for example, page 999, the notch cutter is inserted between pages 998 and 999. (Notations 9xx are not component reference numerals.) Depending on the notch size chosen, the notch may cut into perhaps 40 to 100 leaves. Referring to FIG. 4, the operator places at least this many in a stack 602 above base 100 of the notch cutter, with a stack of higher-numbered pages 603 below base 100. Optionally, a stack 601 of lower-numbered pages can be turned back for convenience.

To insert the notch cutter, the user's right hand grasps the notch cutter, most conveniently by a pair of leaf guide side walls 308L,R, which extend back and up for that purpose. The operator inserts the notch cutter base between, for example, pages 998 and 999, so that base 100 will be resting on page 999, with leaf 997/998 the last to be notched. In placing and aligning the notch cutter, the user's left hand will be resting on top of leaf stack 602, and will be holding the book open if necessary.

The first notch in a book is conventionally located near the top edge of the book. The operator slides the notch cutter up along the fore-edge until left flat surface 308L is adjacent to the top edge of the book leaves. Because of the thickness of the walls of guide cylinder 201 and of leaf guide 300, the notch will be separated from the top edge of the book leaves by an amount adequate to prevent a thin, fragile web from being created.

When the vertical position of the notch cutter has been set, it is pressed toward the book's spine 604, so that the leaf guide arms 602 are in contact with last leaf to be notched 606, best shown in FIG. 4. This correctly sets the lateral alignment angle, so that the notch cutter's center line 103 is perpendicular to the leaf edges. At the same time, the slant of the book spine 604 is adjusted so that the fore-edges of leaf stack 602 above base 100 of the notch cutter is in contact with the full length of guide surface 301.

Figure 5:
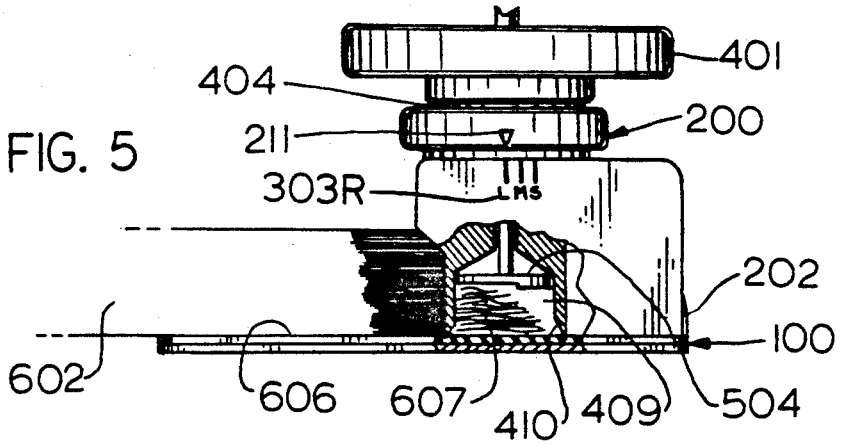
FIG. 5 is a side elevation view of the notch cutter in its "Large" notch size setting.
Figure 6:
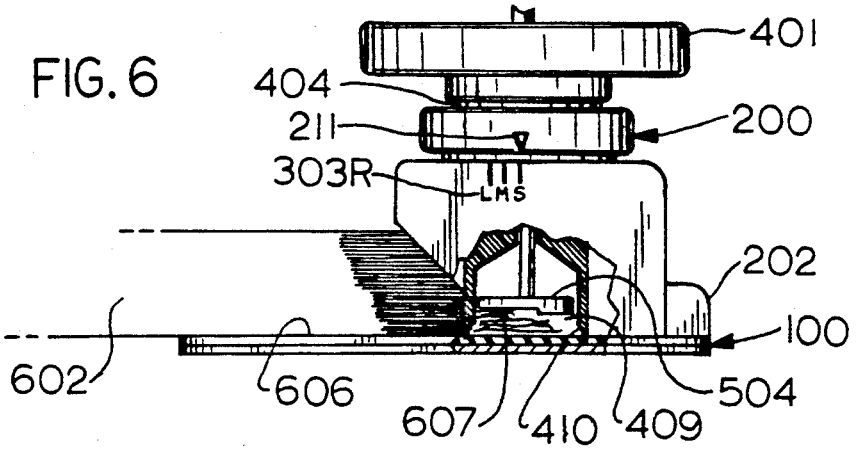
FIG. 6 is a side elevation view of the notch cutter in its "Small" notch size setting.

Positioning the notch cutter takes only a few seconds. Then the operator does the actual cut by simultaneously twisting the knob 401 back and forth and pressing it downward toward base 100. In doing this, the operator's most natural grip on knob 401 is as seen in FIG. 4, such that eject button 501 is not touched or activated. Sharpened cutting edge 410 slices through the edges of book leaves, as shown in FIGS. 5 and 6. Cuttings pile 607 is confined to stay inside cutter cavity 409 during cutting.

During cutting, as cutting member-knob assembly 400 and ejector assembly 500 move downward toward base 100, chips will be building up in pile 607 inside cutter cavity 409, as shown in FIGS. 5 and 6. This causes ejector disk 504 to move upward relative to cutting edge 410.

Figure 7:
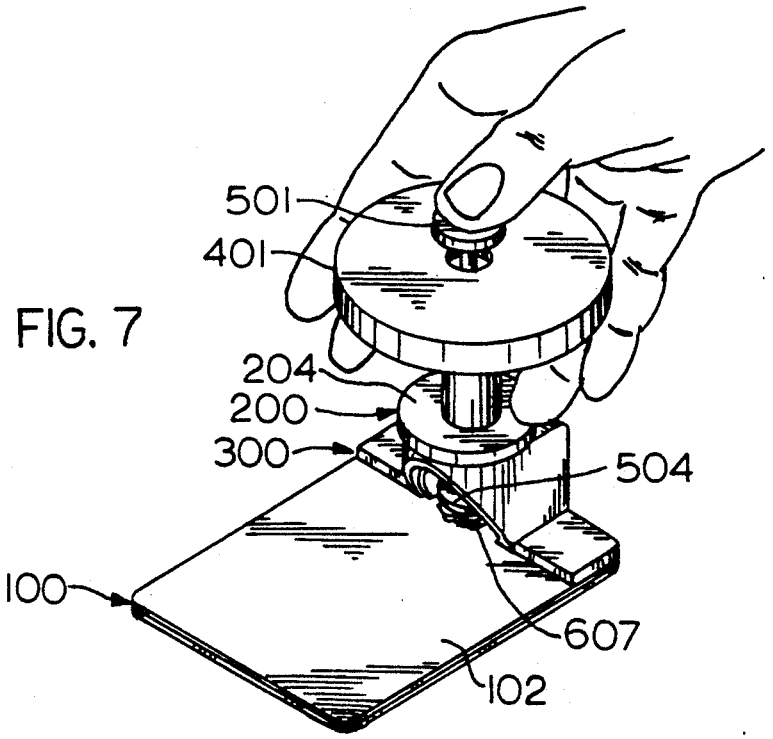
FIG. 7 is a perspective view showing the operator's hand after depressing the eject button and removing the notch cutter from the book.

When the cut is done, the operator changes hand position so that the fingers reach further under knob 401 and the thumb is on button 501, as seen in FIG. 7. Then he or she squeezes the hand, moving the thumb and fingers closer together. This operation forces ejector disk 504 down against chip pile 607, effectively pinning all chips against pad 102, as seen in FIG. 7. Since the hand squeeze can send the ejector disk 504 no further down, the knob 401 will then rise in the ready position, which position is shown in FIG. 3. Then O-ring 407 will be forced to compress into taper 209, where it sticks due to friction.

Maintaining the squeeze, the operator pulls the notch cutter away from the book. If the notch cutter resists being pulled out, the notch has not been completely cut, and more cutting action is required. When the cut is complete, the operator moves the notch cutter to a wastebasket. Holding notch cutter base 100 vertical, the operator releases thumb pressure from button 501, readily releasing chip pile 607, which falls into the wastebasket. The notch cutter is now empty and ready for the next cut.

In this action, cutter guide flange 203, shown in FIG. 3, supplies a friction surface for the back of the fingers, which are positioned between this flange 203 and the knob 401. This light wedging prevents the notch cutter from falling when the operator's thumb is released from the eject button 501.

A few chips may remain stuck, lying on pad 102. These will not impede further cuts and generally will not accumulate. However they can easily be freed with a different hand action, by pressing button 501 until ejector disk 504 is against pad 102, and then turning button 501 back and forth. This will cause chip sweep blade 505 to rotate and displace any chips that are stuck against pad 102. These chips can then be dumped out normally.

In case a notch has been cut which is not deep enough due to incorrect placement of the notch cutter, such a notch can be recut to full depth. With the notch cutter not inserted into the book, the user pushes the cutting member-knob assembly 400 all the way down. The lower end of cutting member 405 will then be easily visible. The user then pushes the notch cutter into the incomplete notch as far as possible. Then the cutting member-knob assembly 400 is raised to the ready position in the normal fashion. The notch cutter can then be pushed further straight in so that it is seated fully, and a notch of full depth cut. Evidence of the incomplete notch is now gone.

To position the notch cutter for the next notch, left flat surface 308L is made to abut the closer edge of the previous notch. Alternatively, closer notch spacings can be achieved by aligning the previous notch instead with left notch spacing guide 309L instead of left flat surface 308L. As will be seen from FIG. 2, spacing mark 309L is closer to centerline 103 of the base, so closer notch spacing will result. For reverse operation, right plane surface 308R or right notch spacing mark 309R can be used instead.

During a cut, the cutting edge 410 is always lying in the plane of the book leaves being cut 602. If the cutting edge 410 at some instant is moving clockwise, the friction created by the cutting action will have some tendency to displace the notch cutter toward the operator. This displacement force will be resisted because the notches in the leaves immediately above the one now being penetrated strongly constrain the cutting member 405's sides from moving laterally. Further, the cutting member 405 will not tend to pull away from the leaves because during a cut, the cutting edge 410 is generally partway through a leaf, which tends to hold it in place. Therefore the perpendicular axis of the cutting member 405 and its rotating drill action will not tend to cause unwanted displacement of the notch cutter, as does occur in the Chase invention.

SUMMARY, RAMIFICATIONS, AND SCOPE

Accordingly, the present invention is a book index notch cutter which is manually powered, handheld, is placed in the book during use, requires no frame, is small, light, and requires no sudden or large forces to operate.

Further, it can cut notches over a continuous range of depths. Also, it operates on large or small books, magazines, and the like, whether hardcover or softcover, whose spines are planar or curved.

Still further, it can cut notches that are deeper than 50% of the maximum notch width. It signals the operator when the cut is complete. Its cutting member stays in the ready position by itself. Its design makes accidental slippage unlikely during the cut. It can be accurately placed over an incomplete cut to finish that cut. It has a thin, light base which aids in positioning the leaves to be cut.

Still further, it aids the user in setting the leaf fan angle and lateral angle. It has calibration guides which help define the notch depth distance and notch spacing along the fore-edge of the book.

Still further, it captures the paper chips in an integral chamber, obviating the need for a separate chamber, which would add size and weight. It allows a simple action to dispose of the cuttings, which action also restores the notch cutter to its ready state. It also has a facility for freeing any stuck chips.

Still further, its use is free of sudden exertion of forces, and keeps its cutting edge inaccessible, improving operator safety. Its cutting edge is also protected against damage by dropping, sudden impact, or contact with other hardened elements.

Finally, since no punching action is involved, it can be constructed with inexpensive, light materials, most of which are molded or stamped, lowering its cost and further improving its utility.

The above description of this invention is very specific, but many of those details should not be construed as limitations on the scope of the invention, but rather as one preferred embodiment. Many variations on these details are possible. For example, rigid support plate 101 could have a high-friction surface on its underside to further help prevent movement of the notch cutter with respect to the book leaves.

Another variation is in the means with which the leaf guide 300 is adjustable for different notch depths. Rather than sliding as described previously, the leaf guide could be made to pivot around an axis parallel to the leaf fore-edges, such axis intersecting the upper part of cutter guide 200. Another alternative for notch depth adjustment is to make leaf guide 300 stationary with respect to base 100, and to have cutter guide 200 adjustable in position by sliding. Leaf guide 200 could also be adjustable by means of a thumbscrew.

Further, knob 401 can have any of a variety of shapes and sizes. Fan angle guide surface 301 can have an angle other than 45 degrees. Reference marks 303 and 211 can be located elsewhere. Finally, alternatives for the cut-done signal and the cutter construction have already been described.

I claim:

1. A book notch cutting machine comprising:

(a) a base which is positioned between a pair of adjacent book leaves while cutting index notches in a book, said base being the bottommost part of said book notch cutting machine;

(b) a cutter guide attached to and having an axis perpendicular to said base and to said leaves;

(c) an attachment means for securing said cutter guide to said base;

(d) a cutting member which is generally circular in cross section and has a sharpened lower edge;

(e) a cutter assembly including said cutting member, said cutter assembly rotating within said cutter guide about said axis, and moving downward parallel to said axis so that said sharpened lower edge is able to cut an arcuate notch into a stack of book leaves by means of a rotary slicing action;

(f) said cutter assembly further including a knob means through which a human operator supplies torque and thrust;

(g) a size and weight of said book notch cutting machine selected such that said book notch cutting machine can be held, moved, and positioned by one of the operator's hands while being used; and (h) an adjustable single piece leaf alignment guide for positioning said book leaves to be notched relative to said book notch cutting machine, said leaf alignment guide further comprising:

a fan angle aligning means consisting of sloped surfaces adjacent to at least one side of said cutter guide, whereby the operator can align said book leaves so that their fore edges lie in a straight line having a predetermined acute angle to said base; a lateral orientation means located adjacent to at least one side of said fan angle aligning means, whereby the operator can determine that said book notch cutting machine is fully seated against said book leaves, even when said book notch cutting machine is located at near the top or bottom edge of the book; and adjustability means, whereby said leaf alignment guide can be positioned for a desired notch depth over an allowable range; a clamping means by which said leaf alignment guide is held immovably in place after it has been positioned for said desired notch depth; and handling surfaces lying oppositely and rearwardly disposed on said leaf alignment guide, on which the operator's finger and thumb can conveniently be placed, thereby providing a gripping position which is stable and near the center of gravity of said book notch cutting machine.

2. The book notch cutting machine of claim 1 wherein said clamping means includes a resilient clamping surface on an upper surface of said base, said resilient clamping surface being recoverably indented by said leaf alignment guide when said clamping means is operative, at which time the indentation and associated friction prevents said leaf alignment guide from moving.

3. The book notch cutting machine of claim 1 wherein said clamping means further includes at least one clamping surface on said leaf alignment guide which cooperates with at least one clamping surface on said cutter guide, whereby said leaf alignment guide is clamped in place by pressure between said base and said cutter guide.

4. The book notch cutting machine of claim 1, further including a plurality of prepared surfaces which upon coming into contact upon completion of the cut provide a sticking effect which impedes further attempts to rotate said knob means, providing a tactile sensation informing the operator that the cut is complete.

5. The book notch cutting machine of claim 1, further including a plurality of irregular surfaces which when in contact and rotating against one another upon completion of the cut, produce a bumping effect which provides an audible and tactile sensation informing the operator that the cut is complete.

6. The book notch cutting machine of claim 1 further including an automatic cutter assembly holding means which can maintain said cutter assembly in a fully raised position in which it is ready to cut, whereby the operator can conveniently place the book notch cutting machine in position for the next cut without having to hold said cutter assembly in place manually.

7. The book notch cutting machine of claim 6 wherein said automatic cutter assembly holding means allows free rotation and axial movement of said cutter assembly once said cutter assembly is below said fully raised position.

8. The book notch cutting machine of claim 1 in which said base includes:

(a) an upper surface upon which rests an upper stack of book leaves to be cut;

(b) a lower surface which generally rests upon a lower stack of leaves of the book;

(c) friction means on at least one of said surfaces, adapted to have, when in contact with book leaves and when augmented by the operator's finger pressure, friction adequate to prevent lateral slippage of said notch cutting machine relative to the book leaves during a notch cutting operation; and (d) stiffening means making said base rigid under forces encountered during a notch cutting operation.

9. The book notch cutting machine of claim 8 in which said friction means is on said upper surface of said base and further provides a resilient platen which supports the leaves being notched, said platen being partly penetrated by said cutting member at the end of the cut.

10. A book notch cutting machine comprising:

(a) a base which is positioned between a pair of adjacent leaves while cutting index notches in a book, said base being the bottommost part of said book notch cutting machine;

(b) a cutter guide attached to and having an axis perpendicular to said base and to said leaves;

(c) an attachment means for securing said cutter guide to said base;

(d) a cutting member which is generally circular in cross section and has a sharpened lower edge;

(e) a cutter assembly including said cutting member, said cutter assembly rotating within said cutter guide about said axis, and moving downward parallel to said axis so that said sharpened lower edge is able to cut an arcuate notch into a stack of book leaves by means of a rotary slicing action;

(f) said cutter assembly further including a knob means through which a human operator supplies torque and thrust;

(g) a size and weight of said book notch cutting machine selected such that said book notch cutting machine can be held, moved, and positioned by one of the operator's hands while being used;

(h) said cutting member having a cylindrical internal cavity cooperating with said base to collect and trap paper cuttings during the cut; and (i) ejector means mounted in and moving relative to said cutter assembly, said ejector means movable axially within said internal cavity so that during ejection the paper cuttings are forced from said internal cavity down against said base, whereby said book notch cutting machine can be moved from the book without spilling said paper cuttings.

11. The book notch cutting machine of claim 10, said ejector means comprising (a) a chip ejector disk positioned inside said internal cavity of said cutting member, having a diameter which substantially fills the diameter of said cylindrical internal cavity and a lower surface which is generally parallel to said base;

(b) a button means mounted above and on the axis of said knob means, positioned in scale to a human hand so that the operator's thumb can operate said button means while the operator's fingers are under said knob means, whereby a squeezing action of the hand will force down said ejector disk, trapping the cuttings against said base and simultaneously forcing said knob means upwards, thus positioning said cutter assembly for the next cut;

(c) an ejector shaft mounted at one end to said ejector disk and at the other end to said button means, said ejector shaft mounted axially within and extending above said knob means, said shaft having a length such that said chip ejector disk has a rest position inside said cutting member cavity and a fully extended position below said cutting member by at least the distance of maximum travel of said cutting member; and (d) spring means mounted on said ejector shaft having a length suitable so that the rest position of said chip ejector disk is recessed within said cutting member internal cavity, whereby said ejector disk in said rest position will not interfere with placing said notch cutting machine against the book edge.

12. The book notch cutting machine of claim 11, wherein said chip ejector disk includes a sweep surface which is generally perpendicular to said lower surface of said ejector disk, the height of said sweep surface being the thickness of several sheets of paper, whereby if said button means is turned on its axis, said sweep surface will dislodge paper chips stuck to an upper surface of said base.

* * * * *